United States Patent [19]

Braun et al.

[11] 3,934,164

[45] Jan. 20, 1976

[54] X-RAY TUBE HAVING COMPOSITE TARGET

[75] Inventors: Martin Braun, Stamford; Joseph R. Suffredini, Darien, both of Conn.

[73] Assignee: The Machlett Laboratories, Incorporated, Stamford, Conn.

[22] Filed: Feb. 14, 1975

[21] Appl. No.: 550,236

[52] U.S. Cl. ..... 313/60; 313/330

[51] Int. Cl.[2] ..... H01J 35/10

[58] Field of Search ..... 313/330, 60

[56] References Cited

UNITED STATES PATENTS 3,842,305 10/1974 Braun ..... 313/60

*Primary Examiner*—R. V. Rolinec
*Assistant Examiner*—Darwin R. Hostetter
*Attorney, Agent, or Firm*—John T. Meaney; Joseph D. Pannone; Harold A. Murphy

[57] ABSTRACT

An X-ray tube including an evacuated envelope having therein a rotatable anode target comprising a cup-shaped disc open toward an electron emitting cathode and having a sloped inner wall provided with an annular groove wherein a plurality of rod-like members are disposed in side-by-side relationship, the rod-like members being made of rare earth composite material to provide substantially monochromatic X-radiation when bombarded with electrons.

20 Claims, 2 Drawing Figures

X-RAY TUBE HAVING COMPOSITE TARGET

BACKGROUND OF THE DISCLOSURE

This invention relates generally to X-ray generating apparatus and is concerned more particularly with an X-ray tube having an anode target made of composite material.

It is well known that the use of highly monochromatic X-radiation in a diagnostic imaging process provides greater contrast and improved image quality, as compared to the continuous, or "white" X-radiation produced by a conventional X-ray tube. Generally the required limited bandwidth of X-radiation is obtained by disposing one or more filters in the path of an X-ray beam emanating from a conventional X-ray tube. However, this technique is inherently wasteful in that most of the X-radiation generated by the conventional X-ray tube is not used in the imaging process.

Therefore, it is advantageous to provide an X-ray tube having means for exciting substantially monochromatic X-radiation directly by electron bombardment.

SUMMARY OF THE INVENTION

Accordingly, this invention provides an X-ray tube comprising an evacuated envelope wherein a rotatable cup-shaped anode disc has a sloped inner wall surface provided with an annular focal track. The focal track comprises an annular channel in the wall surface and having therein a plurality of rod-like target members disposed in side-by-side relationship. The target members are made of a composite material comprising an element from the lathanide series and a lower atomic number element, preferably from the group comprising boron, carbon, and beryllium. Thus, the focal track may comprise an annular array of rod-like members, each being made of cerium boride material, for example.

Disposed in operative spaced relationship with a portion of the focal track is an electron emitting cathode from which the electrons are electrostatically beamed onto the aligned portion of the focal track. As a result, the target members emit characteristic X-radiation which passes out of the tube envelope through an aligned port therein.

Arcuate portions of the annular array of target members may comprise differing respective materials, at least one being a composite material made of a rare earth metal and a lower atomic number element. The annular array of rod-like target members permits arcuate portions thereof to be made of respective materials which are difficult to fabricate or which otherwise perform unsatisfactorily in the form of relatively large mass anode discs. Thus, as the respective arcuate portions pass sequentially into intercepting relationship with the electron beam, there is produced an X-ray beam comprising sequential pulses of respective K characteristic X-radiation emanating from the port of the tube.

BRIEF DESCRIPTION OF THE DRAWINGS

For a better understanding of this invention, reference is made in the following more detailed description to the accompanying drawing wherein.

DESCRIPTION OF THE PREFERRED EMBODIMENT

Figure 1:
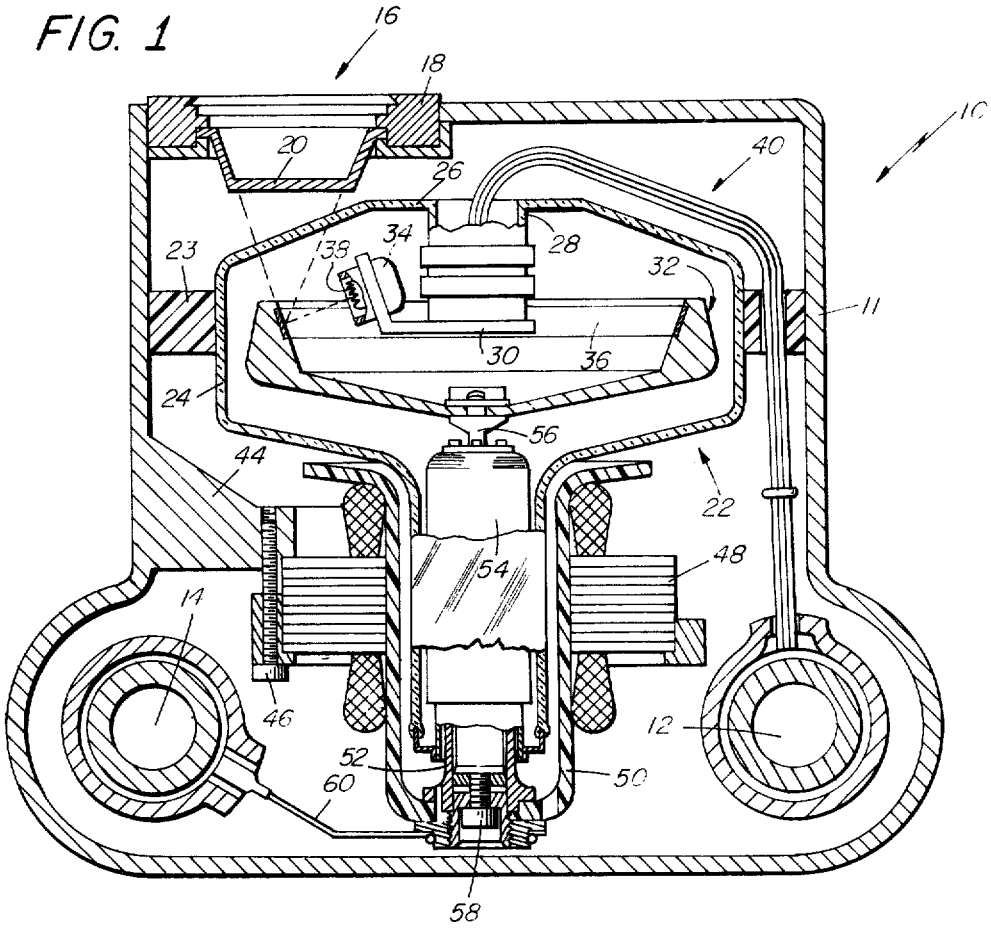
FIG. 1 is an axial view, partly in section, of an X-ray tube embodying the invention.

Referring to the drawing, there is shown in FIG. 1 an X-ray generating device 10 of the type, for example, disclosed in U.S. Pat. No. 3,842,305 granted to the inventor and assigned to the assignee of this invention. The device 10 includes a substantially cylindrical housing 11 having at one end thereof a conventional pair of cable terminal horns, 12 and 14, respectively. The opposite end of housing 11 is provided with a port 16 wherein a bezel 18 supports an X-ray transparent window 20 made of suitable material, such as beryllium, for example.

Within housing 11, an axially extending X-ray tube 22 having an evacuated envelope 24 is maintained in lateral positional relationship with the port 16 by an encircling dielectric ring 23. The adjacent end of envelope 24 is provided with a reentrant portion 26 which is peripherally sealed to one end of a cathode support cylinder 28. The other end of support cylinder 28 is hermetically attached to a hollow arm 30 which extends radially within the opening of a cup-shaped anode disc 32. An angled distal end portion of arm 30 supports a cathode head 34 in operative spaced relationship with a portion of an annular focal track 36 disposed in a sloped inner wall surface of the anode disc 32. Suitably supported within an opening of the cathode head 34 is a filament 38 which emits electrons in the direction of the aligned portion of track 36. The filament 38 is electrically heated to electron emitting temperatures and is maintained at a suitable negative potential with respect to anode disc 32 by means of wires in bundle 40 connecting the filament to respective terminals (not shown) in the horn 12.

The X-ray tube 22 is supported axially with respect to the port 16 by a shoulder 44 extending radially inward from the wall of housing 11. Suitably secured, as by bolt 46, for example, to the shoulder 44 is an induction type stator assembly 48 which has an inner peripheral portion attached to an elongated dielectric cup 50. The closed end of cup 50 is fixedly secured to one end of an anode support cylinder 52 which extends hermetically within the envelope 24. Bearingly mounted on the inner end portion of cylinder 52 is an anode skirt 54 which is rotated by the electromotive action of stator assembly 48. Fixedly attached to the inner end of skirt 54 is a shaft 56 which is secured to a central portion of anode disc 32, whereby the disc 32 rotates with the skirt 54. A bolt 56 threadingly engages an externally extending stud portion of anode support cylinder 52, to electrically connect a wire 60 extending from the horns 14 thereto. The wire 60 provides means for maintaining the anode disc 32 at a suitably high positive potential with respect to the filament 38 in cathode head 34.

Figure 2:
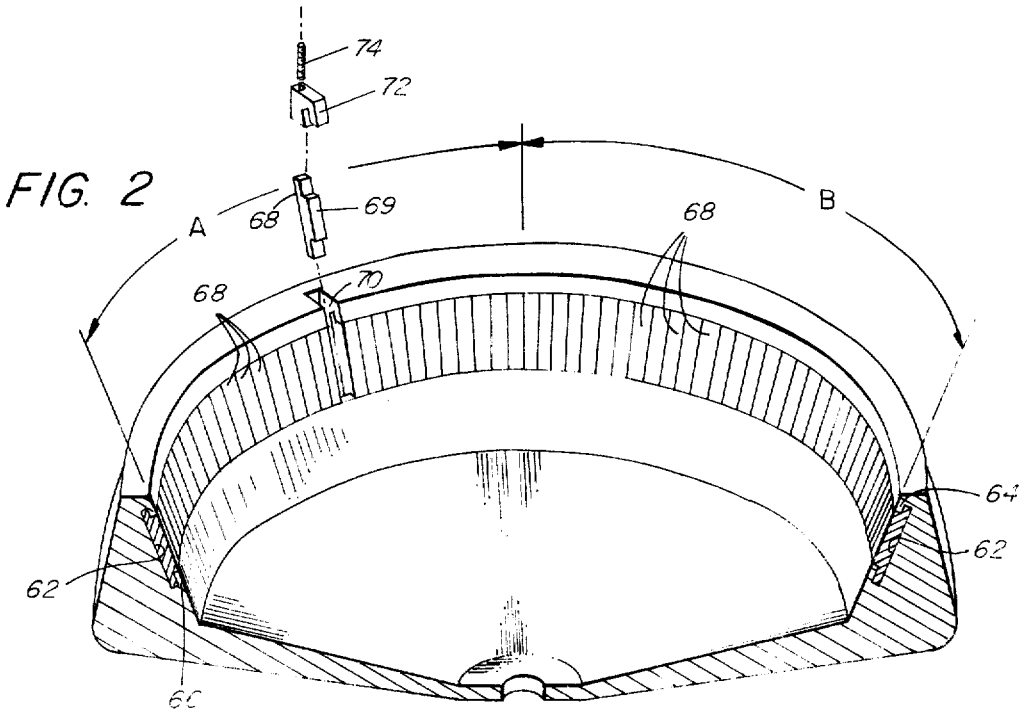
FIG. 2 is an enlarged fragmentary isometric view of the cup-shaped anode disc shown in FIG. 1.

As shown in FIG. 2, the focal track 36 may comprise a slotted groove or channel 62 recessed in the sloped inner wall surface of the cup-shaped anode disc 32. The channel 62 may be provided with upper and lower projecting lips, 64 and 66, respectively, for retaining an annular array of juxtaposed pins or rod-like members 68 within the channel. The members 68 also may comprise wafers or plates of target material having projecting edge portions 69 which extend longitudinally between the lips 64 and 66. Thus, the projecting edge portions 69 may form a laminated annular target surface which is substantially flush with the inner sloped wall surface of the anode disc 32, for example. A suitable opening 70 may be provided in the upper lip 64 of channel 62 whereby the target members 68 may be inserted into the channel and slid arcuately until a suitable annulus of the members is produced. Then a keeper 72 may be suitably secured, as by dowel 74, for example, in the opening 70 to provide a continuous channel 62. Alternatively, the keeper 72 may comprise a continuous retaining ring which is snapped or press-fitted into the open end of anode disc 32 to form the upper edge of channel 62.

In operation, the anode disc 32 is rotated at a suitable velocity, such as ten thousand revolutions per minute, for example, and the filament 38 is electrically heated to an incandescent temperature. As a result, electrons are emitted copiously from the incandescent filament and are electrostatically beamed onto an aligned area, called the "focal spot area" of the focal track 36. Accordingly, the beamed electrons bombard the target members 68 as they rotate sequentially through the focal spot area and generate X-rays which radiate therefrom. The useful portion of this X-radiation passes in a beam out of the tube 22 through the X-ray transparent window 20 in port 16. In order to obtain high resolution in the X-ray imaging process, it is important that the X-ray beams appear to be emanating from a point source of X-radiation. Therefore, the electrons emitted from filament 38 are electrostatically focused onto a very small focal spot area having projected dimensions, as viewed through window 20, on the order of about 1 millimeter square or less. However, the minimized area of the focal spot generally is limited by the heat energy generated by the bombarding electrons pitting the target material. Also, the rotational velocity of the disc 32 is determined by allowing adequate time for the target members 68 to cool sufficiently before again entering the focal spot area of track 36.

Preferably, the juxtaposed target members are assembled in channel 62 with sufficient looseness to permit independent movement of each member 68 within its respective plane. Thus, as the anode disc 32 rotates, each of the members 68 will be urged by centrifugal force against the longitudinal wall of channel 62 and into good thermal contact with the material of anode disc 32. The disc 32 may be made of a material, such as graphite, for example, having relatively high heat capacity to serve as a heat sink for the members 68. Also, the juxtaposed target members 68 are provided with suitable longitudinal dimensions to avoid abutting engagement with the upper and lower transverse walls of channel 62 while undergoing thermal elongation. Accordingly, this flexibility of independent movement provided for each of the target members 68 ensures that the heat generated by the bombarding electrons will not adversely affect the X-ray generating quality of focal track 36.

Thus, when generating substantially monochromatic (or mono-energetic) X-radiation by direct electron bombardment, it is important that the target material have suitable thermal and structural characteristics, as well as being an efficient source of the desired X-radiation. Elements of the lanthanide series, for example, which includes the rare earth elements having atomic numbers from 57 to 71, emit K characteristic X-rays having associated photon energy values slightly greater than the absorption edge energy value of iodine, a commonly used contrast agent. Accordingly, when iodine is introduced into a selected portion of a patient and irradiated with K characteristic X-rays from a rare earth source, the iodine preferentially absorbs this X-radiation thereby providing a sharply defined image of the selected portion. However, as electron bombarded target materials, the rare earth metals generally exhibit poor thermal and structural characteristics, such as low vaporization pressures, low melting points, low mechanical strength, and the like.

Consequently, other means have been devised for obtaining the desired limited bandwidth X-radiation. One means comprises disposing a number of filters in the path of a continuous bandwidth beam emanating from a conventional X-ray tube in order to remove substantially all but the desired X-ray wavelengths from the beam. Another means comprises irradiating a sample of rare earth material with a continuous bandwidth X-ray beam to obtain, by fluorescence, the desired K characteristic X-radiation from the sample. These filtering and fluorescent techniques provide the desired limited bandwidth X-radiation, but at a greatly reduced intensity as compared to the primary X-ray beam. Furthermore, resolution achieved with the desired X-radiation, thus obtained, is relatively low because the secondary or apparent source does not closely approximate a point source.

Accordingly, attempts have been made to develop an anode target disc made of a rare earth compound material in order to obtain the desired K characteristic radiation by direct electron bombardment. However, these attempts have not been too successful generally due to the low thermal shock resistance of the rare earth compound. Thus, the temperature difference between material comprising an element of the lanthanide series and a lower atomic number element in the focal spot area and material in cooler portions of the disc causes the rare earth compound to disintegrate into small pieces. On the other hand, in the practice of this invention, rod-like members 68 made of rare earth compound material do not exhibit such adverse effects. This advantageous result may be due, in part, to the flexibility provided for each of the members 68 to move within its respective plane. Consequently, the members 68 are urged by centrifugal force into good thermal contact with the material of disc 32, which may be made of a material having a relatively high thermal capacity. Also, each of the members 68 is allowed to elongate thermally without adversely affecting the other members 68 in the annular array. Furthermore, it appears that the relatively small mass of each rod-like member 68 permits the entire member to heat up simultaneously, thereby avoiding the undesirable effects of thermal shock due to portions of the target material being heated unequally. As a result, more electron power may be beamed into the focal spot area to provide a higher intensity X-ray beam which requires a shorter exposure time, than would be practical with a solid anode disc made of the same target material.

Therefore, in accordance with this invention, the rod-like members 68 are made of a composite material comprising an element of the lanthanide series and a lower atomic number element, preferably in the group including boron, carbon, and beryllium. It is believed that the lower atomic number element functions as an effective heat sink to dissipate a greater quantity of energy than would be realizable with a target made of a pure rare earth metal. Thus, each of the members 68 in the annular array may be made of cerium hexaboride ($CeB_6$) material, for example, which has a melting point of approximately 2200° C. as opposed to the approximately 800° C. melting point of pure cerium.

The cerium component of the compound emits a K characteristic line X-radiation having an associated photon energy value of approximately 34.7 Kev, which is close to the approximate photon energy value of 33 Kev associated with the absorption edge of iodine. Since the cerium component constitutes 70 percent by weight of the compound material, the yield of the desired K characteristic X-radiation is only 30 percent less than provided by a target of pure cerium. However, this difference in X-ray yield can be compensated by increasing the electron power input to the focal spot area of track 36, because the cerium boride target material has a much higher melting point and a greater heat capacity than the pure cerium target material.

When iodine is used as a contrast agent, any element of the lanthanide series from cerium to approximately gadolinium may constitute the rare earth component of the specified composite target material. Since gadolinium, for example, emits higher energy K characteristic photons than cerium, it may be more suitable for irradiating thick tissue portions of a patient, where the K characteristic photons emitted by cerium are heavily absorbed.

Also, as shown in FIG. 2, the focal track 36 may include arcuate portions designated as "A" and "B", respectively, each comprising a plurality of target members 68 made of a rare earth composite material in accordance with this invention. However, the target members 68 in arcuate portion "A" are made of a different material with respect to the target members 68 in arcuate portion "B". Thus, the resulting X-ray beam passing through the X-ray transparent window 20 may comprise a sequential series of alternate pulses from the target members 68 in respective arcuate portions "A" and "B" of focal track 36. Accordingly, an electronic subtraction technique via video processing may be used, wherein the system is synchronized with the rotation of anode disc 32 to obtain greatly enhanced X-ray images.

Furthermore, the annular focal track 36 may include a plurality of distinct arcuate portions, one of which includes a plurality of rod-like members 68 made of a composite material comprising an element of the lanthanide series and a lower atomic number element. Another arcuate portion may include a plurality of rod-like members 68 made of a barium composite material, for example, since barium emits K characteristic line radiation having an associated photon energy value slightly less than the absorption edge energy value of iodine. Another arcuate portion may include a plurality of rod-like members 68 made of tungsten, for example, which emits K characteristic line radiation having an associated photon energy value much greater than the absorption edge energy value of iodine. Also, another arcuate portion may include a plurality of rod-like members 68 made of a material, such as manganese, for example, which is difficult to fabricate as a solid anode disc target but may be readily reduced to practice in the form of rod-like target members 68.

From the foregoing, it will be apparent that all of the objectives of this invention have been achieved by the structure shown and described herein. It also will be apparent, however, that various changes may be made by those skilled in the art without departing from the spirit of the invention as expressed in the appended claims. It is to be understood, therefore, that all matter shown and described is to be interpreted as illustrative and not in a limiting sense.

What is claimed is:

1. An X-ray tube comprising:

an envelope;

a cup-shaped anode target rotatably supported within the envelope and having an inner wall surface;

an electron emitting cathode supported within the envelope in spaced relationship with the inner wall surface of the target; and an annular focal track disposed on the inner wall surface, the track including composite material made of an element of the lanthanide series and a second element having an atomic number lower than 57.

2. An X-ray tube as set forth in claim 1 wherein the second element comprises an element of the group including boron, carbon, and beryllium.

3. An X-ray tube as set forth in claim 2 wherein the composite material is cerium boride.

4. An X-ray tube as set forth in claim 1 wherein the target is made of a material having a higher heat capacity than the composite material.

5. An X-ray tube as set forth in claim 4 wherein the target is made of graphite material.

6. An X-ray tube as set forth in claim 1 wherein an arcuate portion of the annular focal track comprises a plurality of members having respective elongated surface areas exposed toward the axial centerline of the target.

7. An X-ray tube as set forth in claim 6 wherein the arcuate portion comprises a plurality of rod-like members arranged in side-by-side relationship.

8. An X-ray tube as set forth in claim 7 wherein each of said members is made of the composite material.

9. An X-ray tube as set forth in claim 8 wherein each of said members is made of cerium boride.

10. An X-ray tube as set forth in claim 7 wherein each of said members is made of barium compound material.

11. An X-ray tube as set forth in claim 7 wherein each of said members is made of tungsten.

12. An X-ray tube as set forth in claim 7 wherein each of said members is made of manganese.

13. An X-ray target of the rotating type comprising:

a cup-shaped body having an inner wall surface; and an annular focal track disposed on the inner wall surface and including a composite material made of an element of the lanthanide series and a second element having an atomic number lower than 57.

14. An X-ray target as set forth in claim 13 wherein said inner wall surface is provided with an annular channel and the focal track comprises an annular array of members disposed in the channel.

15. An X-ray target as set forth in claim 14 wherein at least an arcuate portion of the array comprises a plurality of juxtaposed rod-like members.

16. An X-ray target as set forth in claim 15 wherein each of the rod-like members is made of said composite material.

17. An X-ray target as set forth in claim 16 wherein each of the rod-like members is made of cerium boride.

18. An X-ray target as set forth in claim 15 wherein each of the rod-like members is made of barium compound material.

19. An X-ray target as set forth in claim 15 wherein each of the rod-like members is made of tungsten.

20. An X-ray target as set forth in claim 15 wherein each of the rod-like members is made of manganese.

* * * * *